US005234177A

United States Patent [19]

Maji et al.

[11] Patent Number: 5,234,177

[45] Date of Patent: Aug. 10, 1993

[54] MAGNETIC BRAKING APPARATUS AND TENSION CONTROL SYSTEM USING THE MAGNETIC BRAKING APPARATUS

[75] Inventors: Hiroshi Maji, Mie; Hajime Nakamura, Ise; Hikaru Okuno, Misono, all of Japan

[73] Assignee: Shinko Denki Kabushiki Kaisha, Tokyo, Japan

[21] Appl. No.: 691,150

[22] Filed: Apr. 25, 1991

[30] Foreign Application Priority Data

Apr. 25, 1990 [JP] Japan ..... 2-43457[U]
May 8, 1990 [JP] Japan ..... 2-47412[U]
May 30, 1990 [JP] Japan ..... 2-55879[U]

[51] Int. Cl.[5] ..... B65H 23/18
[52] U.S. Cl. ..... 242/75.47
[58] Field of Search ..... 242/75.4, 75.43, 75.44, 242/75.47, 75.5, 75.51, 147 R, 149, 156, 156.1; 188/267

[56] References Cited

U.S. PATENT DOCUMENTS

| | | | |
|---|---|---|---|
| 2,777,545 | 1/1957 | Pockett, Jr. | 242/75.4 |
| 3,217,999 | 11/1965 | McDonald | 242/75.43 |
| 3,354,711 | 11/1967 | Seney | 242/75.43 |
| 3,366,903 | 1/1968 | Searle et al. | 188/267 X |
| 3,797,775 | 3/1974 | White | 242/155 M |
| 4,830,296 | 5/1989 | Ueda et al. | 242/18 DD X |
| 4,844,371 | 7/1989 | Tabara | 242/75.44 |
| 4,853,573 | 8/1989 | Walcott et al. | 188/267 X |
| 4,895,233 | 1/1990 | Inoue et al. | 188/267 X |
| 4,903,909 | 2/1990 | Suzuki | 242/75.4 |

FOREIGN PATENT DOCUMENTS

| | | | |
|---|---|---|---|
| 2531572 | 1/1976 | Fed. Rep. of Germany | 242/75.51 |
| 3408785 | 10/1984 | Fed. Rep. of Germany . | |
| 3437251 | 4/1986 | Fed. Rep. of Germany . | |
| 57-56687 | 12/1982 | Japan . | |
| WO90/05690 | 5/1999 | World Int. Prop. O. | 242/75.4 |

*Primary Examiner*—Daniel P. Stodola
*Assistant Examiner*—John P. Darling
*Attorney, Agent, or Firm*—Oblon, Spivak, McClelland, Maier & Neustadt

[57] ABSTRACT

A magnetic braking apparatus is integrally attached with a load detector such as an arm-like load cell through an attachment member, an outer fin, or a rotary joint between a yoke body and a stationary portion of an outside construction or facility thereby to form a magnetic braking apparatus having a function of load detection. A tension control system incorporates the magnetic braking apparatus with the load detector attached thereto to apply a braking force to a let-off reel. A controller in the tension control system calculates a roll diameter of the let-off reel based on a number of rotations detected by a rotation detector and a number of pulses generated in one rotation of the let-off reel, and generates a control signal representative of a desired braking torque which corresponds to the calculated roll diameter. The controller further receives from the load detector of the magnetic braking apparatus, a feedback signal representative of an actual braking force applied to the let-off reel, and the controller calculates an error signal between the desired braking torque signal and the feedback signal. The error signal is applied to the magnetic braking apparatus to excite the same. Thus, the accuracy of tension control is improved.

11 Claims, 10 Drawing Sheets

MAGNETIC BRAKING APPARATUS AND TENSION CONTROL SYSTEM USING THE MAGNETIC BRAKING APPARATUS

BACKGROUND OF THE INVENTION

1. Field of the Invention

The present invention relates to a magnetic braking apparatus, and in particular, to an improvement of the magnetic braking apparatus to enable detection of a load applied thereto, and to a tension control system of a roll diameter proportion type employing the magnetic braking apparatus.

In a process of letting off or taking up paper or web, in order to prevent slack or excessive tension of the paper or the web, the tension is controlled to maintain constant tension. In such a process, a magnetic braking apparatus having a sensor capable of measuring a load or a braking torque is very beneficial.

2. Description of the Prior Art

A prior art electromagnetic powder brake as a magnetic braking apparatus which is incorporated in a tension control system is shown, for example, in FIG. 1.

With reference to FIG. 1, a yoke 1 extending circumferentially and an exciting coil 2 accommodated in an annular recess of the yoke 1 constitute field body or an electromagnet portion which produce a magnetic field. A rear bracket 3 and a front (input side) bracket 4 support the field body stationary by a strut 4*a* which is secured to a base 4*b*. A cylinder 7 having a side plate 5 is secured to an input shaft 6 which is supported by bearings 9 rotatably. An outer peripheral wall of the cylinder 7 is divided into two parts by an interrupting ring 8 of a non-magnetic material. A stationary rotor 10 is secured to the rear bracket 3. A magnetic powder 11 is sealed in an air gap between an outer peripheral surface of the rotor 10 and an inner peripheral surface of the cylinder 7.

In operation, when the coil 2 is excited by a DC current, magnetic flux is generated and flows along a path shown by the dotted line, from the yoke 1 to cylinder 7 to magnetic powder 11 to rotor 10 to magnetic powder 11 to cylinder 7 and to yoke 1. As a result, the magnetic powder 11 is magnetized by the magnetic flux and particles of the magnetic powder 11 chain together and solidify so that a braking force is applied from the stationary cylinder 7 to the input shaft 6 through the magnetic powder 11. This braking force corresponds to the magnitude of the current supplied to the exciting coil 2, and the braking action is performed with a slip produced between the cylinder 7 and the rotor 10.

However, the following problems are involved in the prior art magnetic braking apparatus.

Since the prior art magnetic braking apparatus is not provided with a device for detecting a braking torque or detecting a load applied to the magnetic braking apparatus, when it is desired to measure the braking torque or the load, it is necessary to use separate torque measurement equipment or a load detecting device.

In particular, recently, since the magnetic braking apparatus such as an electromagnetic powder brake is incorporated in an automatic control system requiring a high accuracy including a tension control system, it is indispensable to detect a torque or a load in order to perform a feedback control.

In the prior art magnetic braking apparatus, in order to meet the aforementioned requirements, a load detecting device or the like must be equipped separately, and the associated facility will become large and expensive In order to improve the above-mentioned drawbacks, a proposal by the applicant's company is disclosed in Japanese Patent Publication No. 57-56687. In this prior art motive power measuring apparatus employing an electromagnetic powder brake, as shown in FIGS. 2 and 3, an electromagnetic powder brake 51 is driven by a prime motor (not shown) to be measured such as an electric motor (not shown), and it absorbs generated motive power generated by the prime motor. The electromagnetic powder brake 51 includes a rotary shaft 52, a rotor 53 secured to the rotary shaft 52 and having a substantially T-shaped longitudinal cross section in its half part, and non-magnetic rings 54, 54 forming two halves of a cylindrical portion of the rotor 53. A stator 55 (which is also rotatable as described later) includes outer yokes 56, 56 inner yokes 56', 56', exciting coils 57, 57, connecting rings 58, 58 for connecting the outer and inner yokes 56 and 56' respectively, and a coupling ring 59. The stator 55 is rotatably supported by supporting members 60, 60 secured to the stator 55, bearing housings 61, 61, support table 62, and bearings 63, 63. Bearings 64, 64 support the rotor 53 and rotary shaft 52 rotatably with respect to the stator 55. Magnetic powders 65, 65 are sealed on an outer and inner surfaces of the cylinder portion of the rotor 53.

A torque arm 70 made of metal is secured to an outer surface of the stator 55 and is extending radially from a center portion in an axial direction. A load transducer 66 is fixed between the torque arm 70 and a fixing member 68 which is secured to the support base 62. The load transducer 66 is expanded or compressed within a certain range under a tension or compression, and transforms a reaction force into a load. As a result, the rotation of the brake 51 is limited in a range in which the load transducer 66 is allowed to expand or to be compressed. A tachometer generator 69 is coupled to the rotary shaft 52.

In the case where the rotor 53 is rotating, when the coils 57, 57 are excited, closed circuits of magnetic flux are formed, and a coupling force is produced between the stator 55 and the rotor 53 through chained and solidified magnetic powders 65, 65. As a result, the stator 55 tends to rotate, however, since the rotation of the stator 55 is limited by the load transducer 66 connected to the stator 55 through the torque arm 70, a braking force is applied to the rotor 53, and thus, to the prime motor to be measured. A reaction force of this braking force is applied to the load detector 66 through the torque arm 70. Accordingly, when an output signal of the load transducer 66 is amplified and displayed on a load display device (not shown), the braking force can be measured as rotation moment which corresponds to the product of the braking force and a length of the torque arm 70. Thus, the motive power of the prime motor to be measured can be measured from a relation between a rotational speed to the rotary shaft 52 obtained by the rotation tachometer 69 and the rotation moment.

However, in this prior art motive power measuring apparatus, the following problems are involved. Specifically, in this apparatus, since it is the purpose to obtain the generated motive power and not the load itself, the accuracy of the load measurement is not so high. Furthermore, in the structure of detecting the load, the braking force which is transmitted as a reaction force from the stator of the electromagnetic powder brake is once transmitted to the torque arm made of metal. Then, the braking force is transmitted to the load transducer 66 which is installed horizontally on the support base 62 through the fixing member 68. As a result, the number of parts is increased, and the accuracy is low due to indirect detection of the load. This accuracy is not satisfactory in the field of a tension control system for letting off a web.

A prior art tension control system of the roll diameter proportion type which incorporates a magnetic braking apparatus of the types as described above is shown in FIG. 4. The tension control system (e.g., a tension controller PCA-101 of Shinko Denke Kabushiki Kaisha) is used in a let-off (unwinding) process of a web.

With reference to FIG. 4, the tension control system is used to let off, unwind, or feed a material, for example, a web, or paper 100 while adjusting the tension of the web. The web 100 is let off from a driving (let-off) reel 101. A rotation detector 102 including a detection disk 103 and a proximity sensor 104 is provided. The detection disk 103 is fixed to the driving reel 101 coaxially and has a projection 103*a* on a periphery of the detection disk 103. The proximity sensor 104 detects passing of the projection 103*a* and generates a pulse for each rotation of the detection disk 103.

A driven roller 105, and pinch rollers 106 and 107 are provided along the path of the web 100. A take-up reel 111 is also provided to take up the web 100. A pulse generator 108 is coupled to the pinch roller 107, and it generates pulses whose number corresponds to a take-up speed of the web 100. A controller 109 calculates a diameter (roll or thickness) of the wound web 100 based on a time period of one rotation of the disk 103 and the number of pulses during one rotation supplied from the pulse generator 108, and based on the following relationships among the torque, tension, and the diameter, supplies an exciting voltage Vf required to obtain a predetermined tension to an exciting coil 110*a* of a magnetic braking apparatus 110 such as an electromagnetic powder brake or the like.

FIG. 5 is a block diagram illustrating the principles of operation of the prior art tension control system including the controller 109 and the magnetic braking apparatus 110, and F is the tension, D is the let-off diameter, and T is the torque. In this case, supposing that braking torques at the start and finish of the let-out operation are represented respectively by Ts and Te, The braking torques are expressed as follows.

$$Ts=(F\max\times D\max/2)\times 10^{-3}\ (\text{kgm}) \quad (1)$$

$$Te=(F\max\times D\max/2)\times 10^{-3}\ (\text{kgm}) \quad (2)$$

Where, Fmax is a maximum set tension, Dmax and D min are respectively a maximum let-off diameter and a minimum let-off diameter.

Furthermore, in the prior art tension control system as shown in FIG. 4 and employing the aforementioned magnetic braking apparatus the following problems are involved.

With reference to FIG. 6, when the tension is maintained at a set tension, the torque-roll diameter characteristic is represented by a curve (A) in which the torque T is proportional to the roll diameter (diameter of the web wound about the let-off reel) D. However, the braking torque which is actually applied to the driving reel 101 by the magnetic braking apparatus 110 is changed as shown by the curve (B). Namely, in a region wherein the roll diameter D is small, the braking torque T is smaller than the set value, and in a region wherein the roll diameter D is large, the braking torque T is larger than the set value. As a result, the control for maintaining the tension at a constant value cannot be performed properly. This drawback becomes especially significant when the electromagnetic powder brake is used as the magnetic braking apparatus, and the utilization of the electromagnetic powder brake is rather disturbed due to the required accuracy irrespective of the fact that the electromagnetic powder brake is excellent in the slip characteristic.

Furthermore, in the prior art tension control system, a part of the braking torque is dissipated as a mechanical loss and the like, and the tension does not become constant.

SUMMARY OF THE INVENTION

In order to solve the above mentioned problems, it is an object of the present invention to provide a magnetic braking apparatus provided with a load detection means, which is capable of measuring the braking torque or load easily with a simple construction.

In a magnetic braking apparatus in the present invention, a load detection means constituted by a load cell having an arm type piezoelectric element wound with a coil is provided to bridge between an outer surface of the magnetic braking apparatus itself and a stationary portion outside the magnetic braking apparatus. In a preferred embodiment, the outer surface of the magnetic braking apparatus itself is an outer fin, or the yoke, and alternatively, an attachment member is used, or the load cell is attached through a rotary joint.

Another object of the present invention is to provide a tension control system employing the above-mentioned magnetic braking apparatus having the load detection means, wherein the magnetic braking apparatus applies a braking force to a let-off reel of the tension control system.

A tension control system in the present invention includes a let-off reel, a rotation detector for detecting a number of rotations of the let-off reel, pinch rollers, a pulse generator coupled to one of pinch rollers for detecting a let-off speed of a material to be let off, and a controller. The controller is supplied with output signals from the rotation detector and the pulse generator, and calculates an instant roll diameter. The controller further receives a feedback signal from a load detector of the magnetic braking apparatus representative of a tension of the material to be let off detected by the load detector, and produces an error signal between the tension control signal and the feedback signal thereby to control the excitation of the magnetic braking apparatus. Thus, the accuracy of the tension control is improved to a great extent. Furthermore, when a signal corresponding to a mechanical loss is added to the tension setting signal in advance, the influence of the mechanical loss can be removed.

DESCRIPTION OF THE PREFERRED EMBODIMENTS

Figure 1:
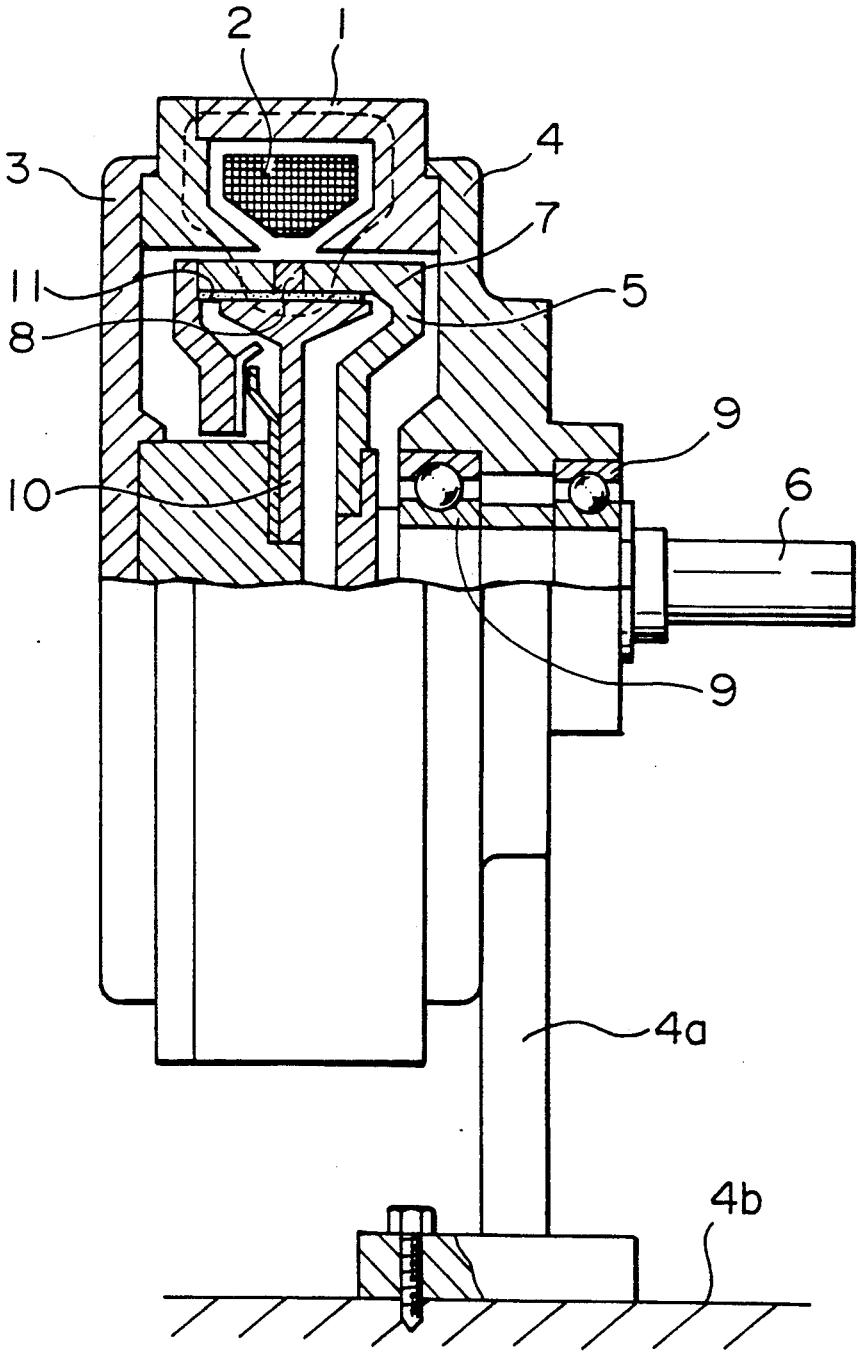
FIG. 1 PRIOR ART
FIG. 1 is a half longitudinal sectional front view of a prior art magnetic braking apparatus.
Figure 2:
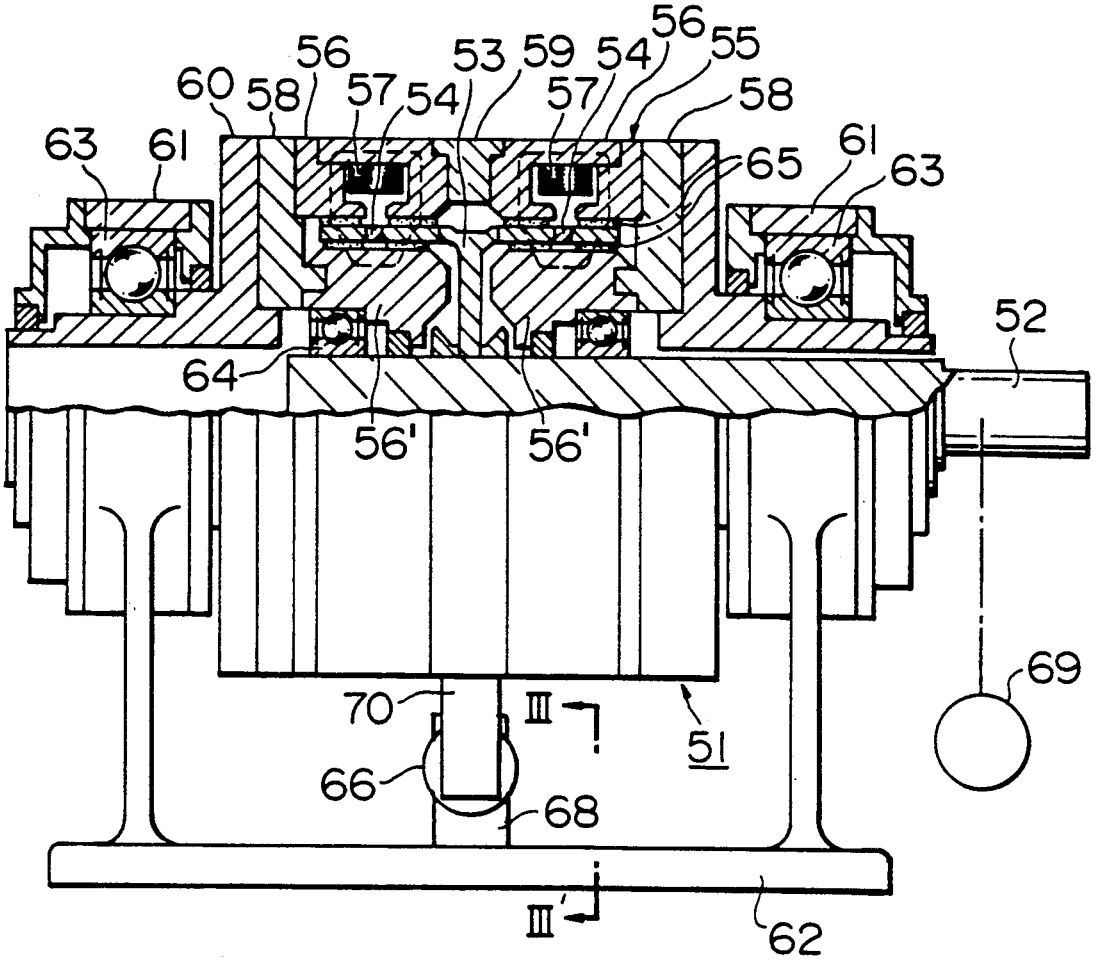
FIG. 2 PRIOR ART
FIG. 2 is a half longitudinal sectional front view of another prior art magnetic braking apparatus.
Figure 3:
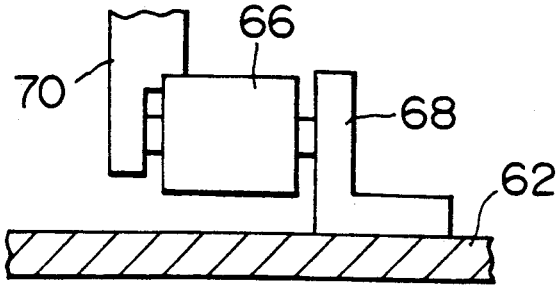
FIG. 3 PRIOR ART
FIG. 3 is a side view of a part of the magnetic braking apparatus of FIG. 2 as viewed in the direction of arrows III—III in FIG. 2.
Figure 7:
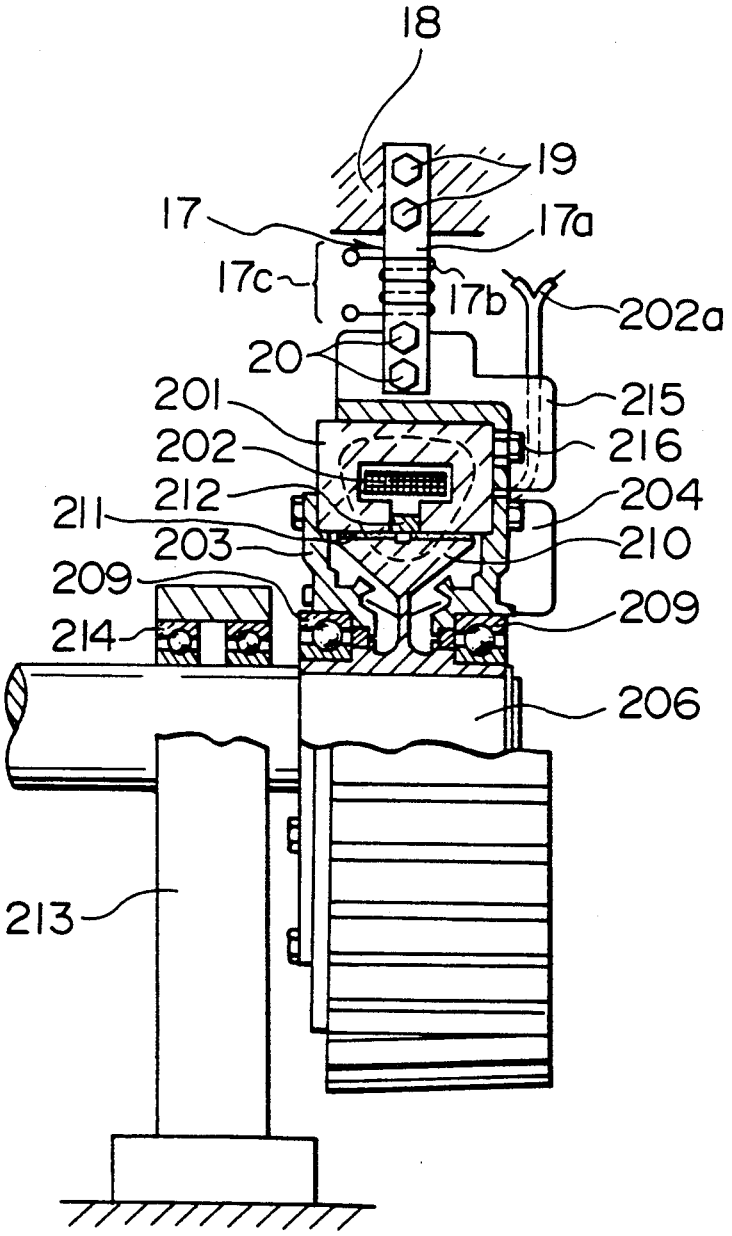
FIG. 7 is a front view partly in longitudinal cross section of a magnetic braking apparatus of a first embodiment of the present invention.

With reference to FIG. 7, an electromagnetic powder brake as a magnetic braking apparatus of a first embodiment is shown. This electromagnetic powder brake differs from the prior art electromagnetic powder brake of FIG. 1 in the provision of a load detector 17 and in the structure of the electromagnetic powder brake in that the cylinder 7 and the side plate 5 are not provided. However, these structural differences are not essential to the performance of the electromagnetic powder brake itself. A substantially cylindrical yoke 201 has an exciting coil 202 accommodated in an annular recess of the yoke 201 so that the exciting coil 202 extends circumferentially. A non-magnetic interruption ring 212 is inserted in an inner peripheral portion of the yoke 201 to magnetically divide the inner peripheral portion of the yoke 201 to enable magnetic flux to pass through magnetic powder as will be described later. A rotor 210 is directly connected to an input shaft 206 to rotate unitarily. The input shaft 206 in turn is connected to a machine (not shown) to be braked. The magnetic powder 211, for example, spherical particles of Fe, Al and Cr alloy is inserted in a gap between an inner peripheral surface of the yoke 201 and an outer peripheral surface of the rotor 210. Brackets 203 and 204 support the yoke 201 rotatably with respect to the rotor 210 through bearings 209. A strut 213 supports the input shaft 206 rotatably through bearing 214, and thus, the strut 213 supports the electromagnetic powder brake. Input terminals 202*a* of the exciting coil 202 are exposed.

A plurality of outer fins 215 for radiating heat are fixed to a side surface of the yoke 201 by bolts 216 or the like.

The load detector 17 for detecting a braking force or a load applied by the electromagnetic powder brake to the machine connected to the input shaft 206 as a reaction force imparted to the yoke 201, includes a piezoelectric element 17*a* of an elongated rectangular plate shape, a detection coil 17*b* wound about the piezoelectric element 17*a*. The detection coil 17*b* has two output terminals 17*c*. One end of the piezoelectric element 17*a* is fixed to one outer fin 215 by bolts 20, and the other end is fixed to a stationary portion 18 of an outside facility or construction by bolts 19. The load detector 17 in this embodiment is attached between one of the outer fins 215 and the outside stationary portion 18 vertically bridging therebetween. As a result, the reaction force imparted to the outer fin 215 in a circumferential direction acts on one end of the piezoelectric element 17*b* perpendicularly to bend or strain the same with respect to the other end which is fixed to the stationary portion 18. Accordingly, an output signal representative of the magnitude and direction of the reaction force, i.e., the braking force or load is obtained at the output terminals 17*c*.

Figure 8:
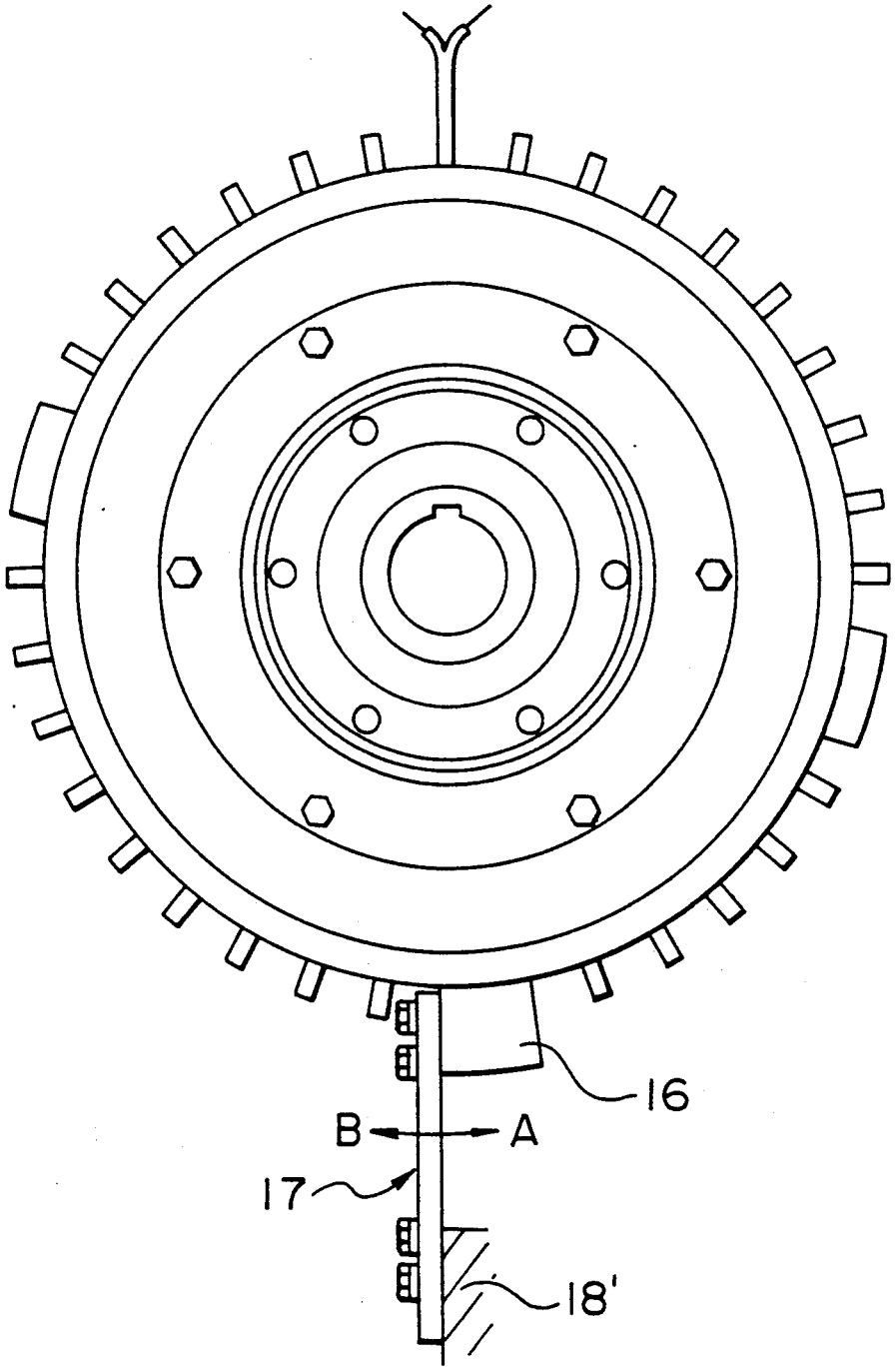
FIG. 8 is a side view of a magnetic braking apparatus of a second embodiment of the present invention.

FIG. 8 shows a second embodiment of the present invention, and the difference from the first embodiment of FIG. 7 resides in that the load detector 17 is attached between a structural member 16 positioned at a lower end of the electromagnetic powder brake and a atationary portion 18' on the ground side. In this case also, the reaction force is applied to the load detector 17 in a circumferential direction A or B and perpendicularly. A similar output signal is obtained from the load detector 17.

Figure 9:
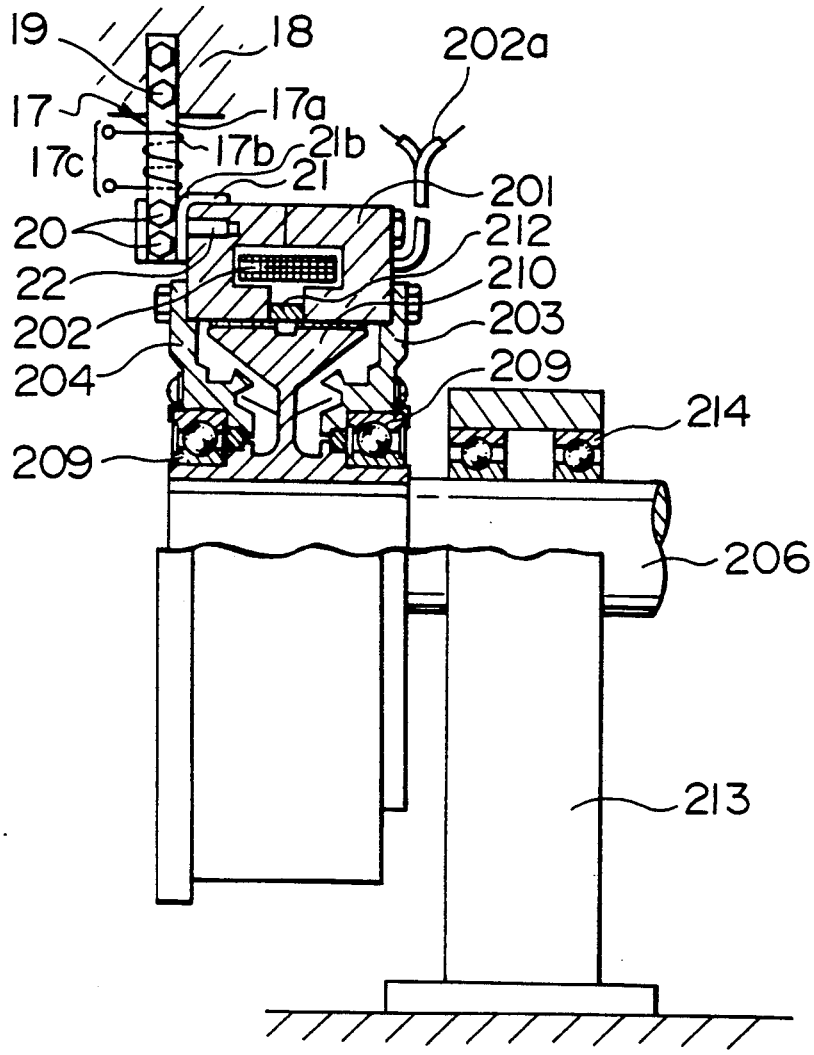
FIG. 9 is a front view partly in longitudinal cross section of a magnetic braking apparatus of a third embodiment of the present invention.
Figure 10:
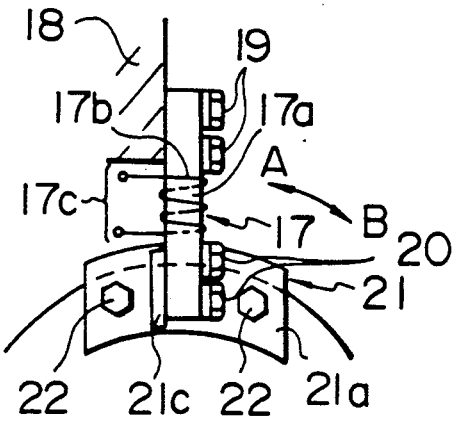
FIG. 10 is a side view of a part of the magnetic braking apparatus of FIG. 9.
Figure 11:
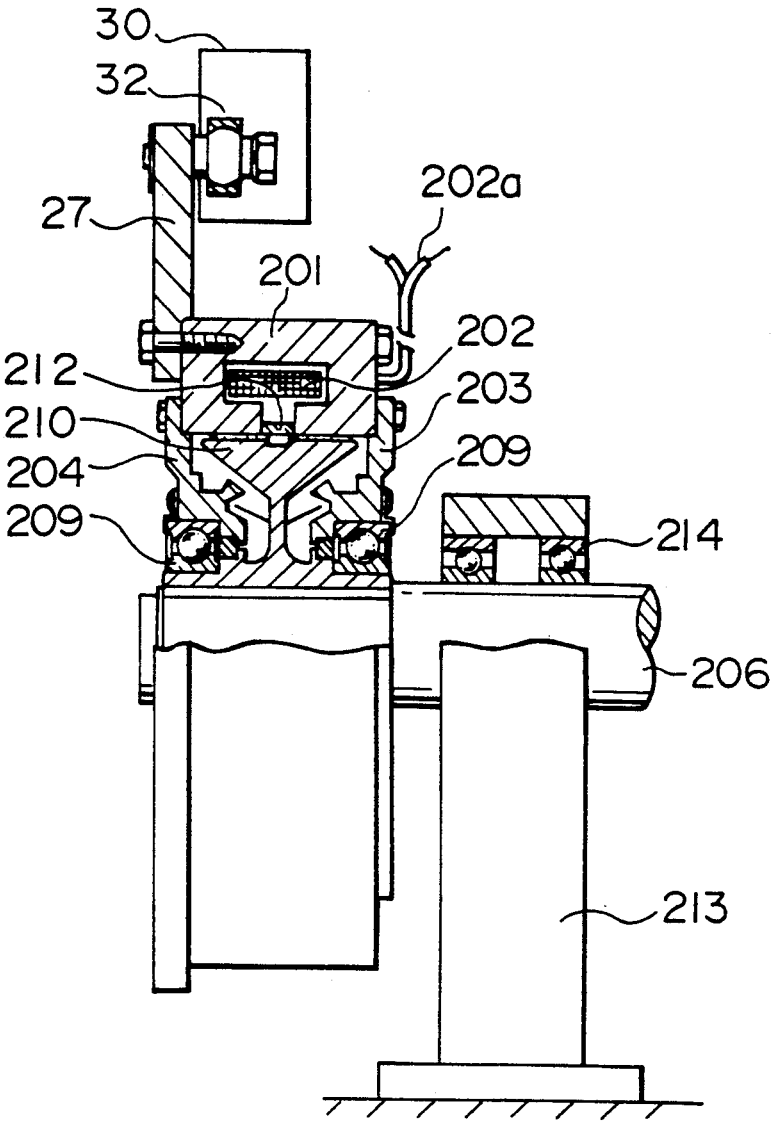
FIG. 11 is a front view partly in longitudinal cross section of a magnetic braking apparatus of a fourth embodiment of the present invention.
Figure 12:
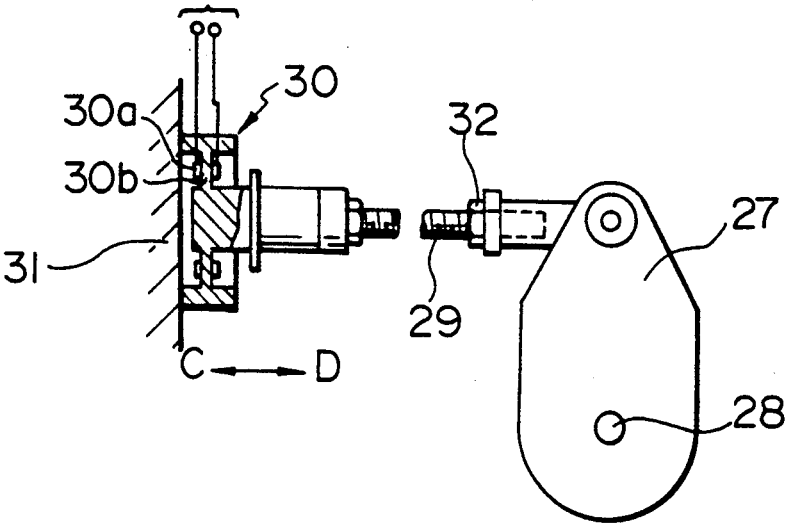
FIG. 12 is a side view of a part of the magnetic braking apparatus of FIG. 11.
Figure 13:
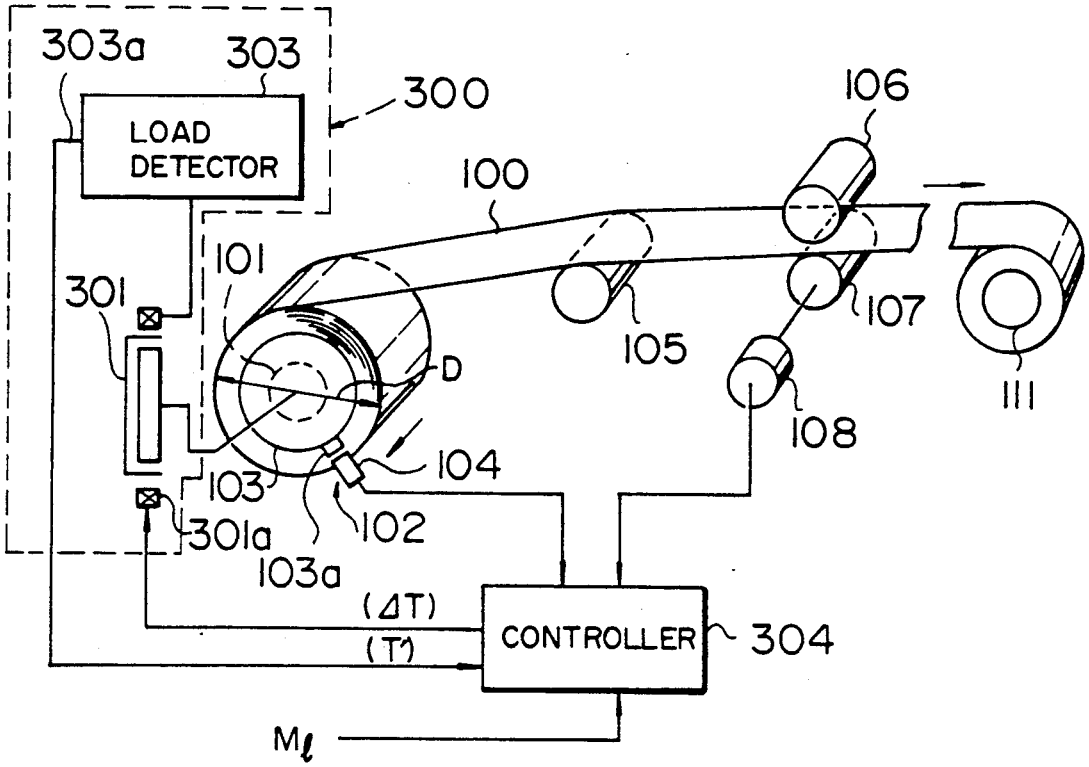
FIG. 13 is a perpective view with a part thereof represented by a block diagram of a tension control system of the present invention which employs any one of the magnetic braking apparatus shown in FIGS. 7 to 12.
Figure 14:
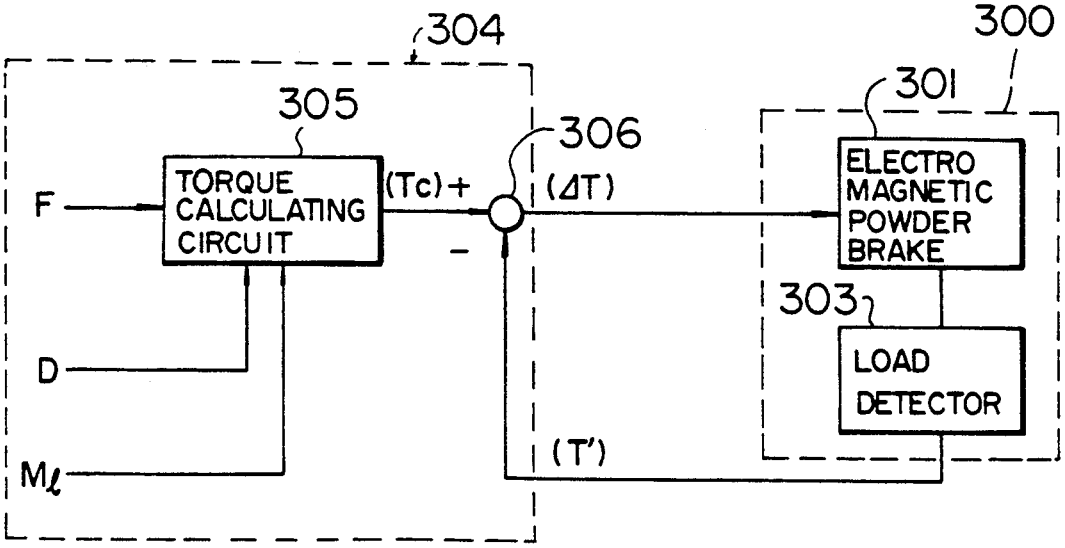
FIG. 14 is a block diagram for explaining the operation of the tension control system of FIG. 13.

FIGS. 9 and 10 show a third embodiment of the present invention. The structure of the electromagnetic powder brake itself is entirely the same as in first embodiment of FIG. 7 with the exception that the outer fins 215 are not provided in the electromagnetic powder brake of FIG. 9 (FIG. 9 is a view of the opposite side of FIG. 7). A load detector 17 which is the same as the one shown in FIG. 7 is attached at one end to the yoke 201 by means of an attachment member 21 which is fixed to the yoke 201 by bolts 22. The other end of the load detector 17 is fixed to a stationary portion 18 of an outside construction or facility. The attachment member 21 has a flat plate portion 21*a* which is directly fixed to one side of the yoke 201 by bolts 22, and has an angled plate portion 21*b* which is bent over an upper edge surface of the yoke 201, and further has a perpendicular plate portion 21*c* which protrudes at right angles from the flat plate portion 21*a* in a direction opposite to the yoke 201. The one end of the load detector 17 is fixed to this perpendicular plate portion 21*c* by the bolts 20. Also in this case, the reaction force of the electromagnetic powder brake imparted in the circumferential direction acts on the load detector 17 through the attachment member 21 in the perpendicularly direction A or B as shown in FIG. 10. Accordingly, a similar output signal as in the first embodiment of FIG. 7 is obtained from the lead detector 17. FIGS. 11 and 12 show a fourth embodiment of the present invention. The structure of the electromagnetic powder brake itself is entirely the same as in first embodiment of FIG. 7 with the exception that the outer fins 215 are not provided in the electromagnetic powder brake of FIG. 11 (FIG. 11 is a view of the opposite side of FIG. 7). A rotary joint 27 has a fixing portion at a lower end, and this portion is fixed to the yoke 201 by a bolt 28 or the like. A movable portion at an upper end of the rotary joint 27 which portion containing a ball therein is connected to a load detector 30 through an adjusting rod 29. The load detector 30 is constituted by a compression type load cell, and includes four strain gauges 30*a* bonded to both sides of a flat portion of a detection section 30*b*. The detection section 30*b* has a rod portion which extends outwardly from the center of the flat portion, and the end of the rod portion is connected to the adjusting rod 29. Output terminals 30*c* are connected to the strain gauges 30*a*. The load detector 30 is secured to a stationary portion 31 of an outside construction or facility. When a force is applied to the detection section 30*b* through the adjusting rod 29 in a direction of C or D, the flat portion of the detection section 30*b* is strained, and this strain is transformed into an electrical signal by a piezoelectric action of the strain gauges 30*a*. The electrical signal is outputted from the output terminals 30*c*. The adjusting rod 29 is adjusted by a double nut 32. As will be seen from the above-mentioned arrangement, as compared with the third embodiment, a fine adjustment can be made so that a load is applied in a tangential direction shown by the arrow C or D.

In the fourth embodiment, since the load detector 30 is mounted through the rotary joint 27 and the adjusting rod 29, the braking torque is transmitted to the load detector 30 through an intermediate intervening member such as the rotary joint 27, the adjusting rod 29 and the like, a strain corresponding to the direction shown by the arrows C or D in FIG. 12 and corresponding to a magnitude of the braking torque is generated.

Accordingly, the strain is transformed into an electric signal by the Piezoelectric effect within the load detector 30, and an electric signal corresponding to the braking torque can be obtained.

As described above, in each of the embodiments in the present invention, the magnetic braking apparatus is provided with a load detection means integrally with a yoke. Accordingly, the accuracy of detecting a load is high, and when this magnetic braking apparatus is used in an automatic control system for tension control or the like, it is possible to use an electric signal corresponding to a braking torque (load) detected by the apparatus itself for feedback control as it is.

Furthermore, in each of the embodiments, while the electromagnetic powder brake is explained as a magnetic braking apparatus, the present invention is not limited to this embodiment. It is only required that an electromagnetic brake is of the type in which the braking torque is transmitted circumferentially about the input shaft, and the load detector described in each of the embodiments can be used bridging between the yoke of, for example, a friction disk type brake, a hysteresis brake, an eddy current type brake, or the like and a stationary portion of the outside construction. In the case of the friction disk type brake, the hysteresis brake, and the eddy current type brake, since there is no intermediate torque transmitting medium such as a magnetic powder, a corresponding part to the rotor or the cylinder connected to the inputs shaft in the electromagnetic powder brake will be a rotor or an armature.

Figure 4:
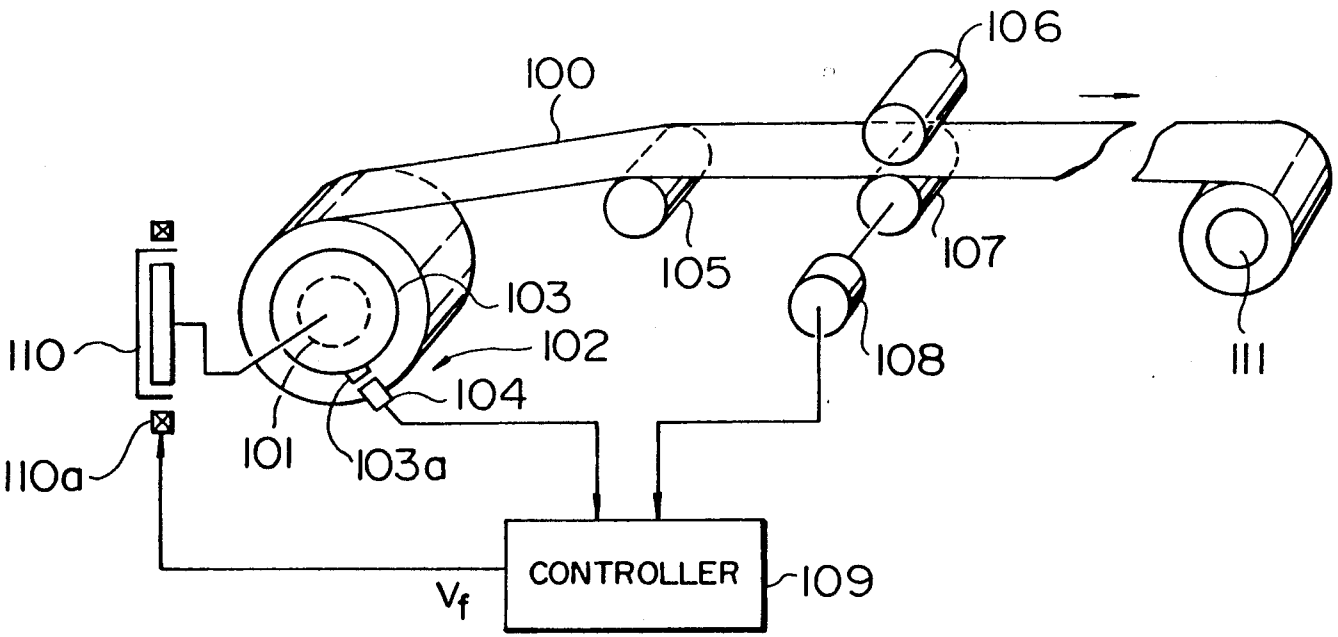
FIG. 4 PRIOR ART
FIG. 4 is a perspective view of a prior art tension control system with a part thereof represented by a block diagram.
Figure 5:
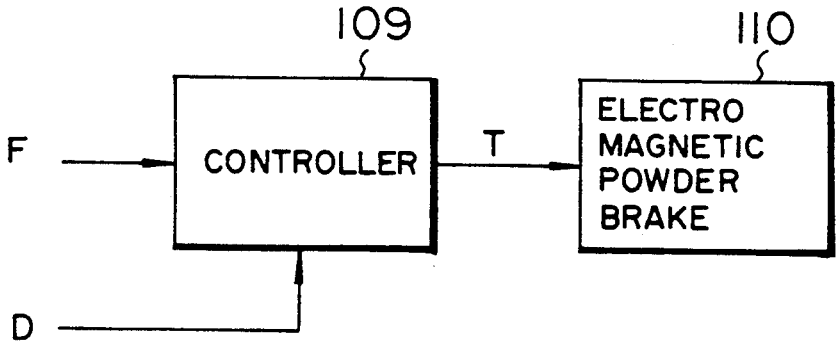
FIG.5 PRIOR ART
FIG. 5 is a block diagram for explaining the operation of the prior art tension control system of FIG. 4.
Figure 6:
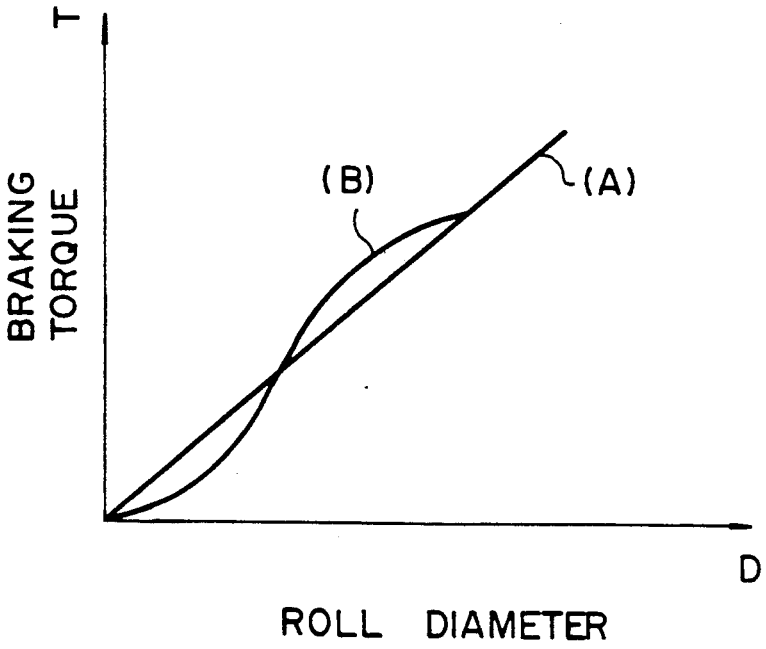
FIG.6 PRIOR ART
FIG. 6 is a graph for explaining the operation of the prior art tension control system of FIG. 4.

With reference to FIGS. 13 to 16, an embodiment of a tension control system will be described. In the tension control system of the roll diameter proportion type, the braking torque (exciting current) is controlled in accordance with a roll diameter so that a desired tension is maintained regardless of a change of the roll diameter between a maximum roll diameter and a minimum roll diameter. In such a tension control system, the required braking torque reduces linearly or proportionally with reducing roll diameter. Furthermore, when an electromagnetic powder brake is used, owing to its exciting current to braking torque characteristic, by adjusting the exciting current in accordance with a roll diameter, the required braking torque can be obtained. As compared with the prior art tension control system of FIG. 4, a web let-off system including a let-off reel 101, a driven roller 105, pinch rollers 106, 107, a pulse generator 108, a take-up reel 111, and a rotation detector 102 is the same as that in FIG. 4. The differences between the tension control system in the present invention and the prior art tension control system reside in that, in the present invention, a magnetic braking apparatus 300 described with reference to FIGS. 7 to 12 is used, and a controller 304 which further receives an output signal from the magnetic braking apparatus 300 is used. An input shaft of the magnetic braking apparatus 300 is directly connected to a rotary shaft of the let-off reel 101. Specifically, the controller 304 receives a feedback signal T' representative of a load or a braking torque applied to the let-off reel 101 by the magnetic braking apparatus 300, and the controller 304 outputs a control signal which includes a component to compensate for a mechanical loss Ml which is caused in rotating members of the tension control system.

The magnetic braking apparatus 300 which may be any one described with reference to FIGS. 7, 8, 9, and 11, includes an electromagnetic powder brake 301 having an exciting coil 301*a*, and a load detector 303 which corresponds to the load detector 17 shown in FIGS. 7 to 9, or the load detector 30 shown in FIGS. 11 and 12. The controller 304 is connected to the rotation detector 102, the pulse generator 108, and the load detector 303 to receive respective output signals, and further connected to the exciting coil 301*a* of the electromagnetic powder brake 301 to supply the control signal. Further, a mechanical loss compensation signal Ml is supplied to the controller 304 externally.

In operation, the controller 304 calculates a diameter D of the web-wound let-off reel 101 (hereinafter, referred to as a roll diameter of the let-off reel 101) in accordance with the output signals from the rotation detector 102 and the pulse generator 108 as described before.

Figure 15:
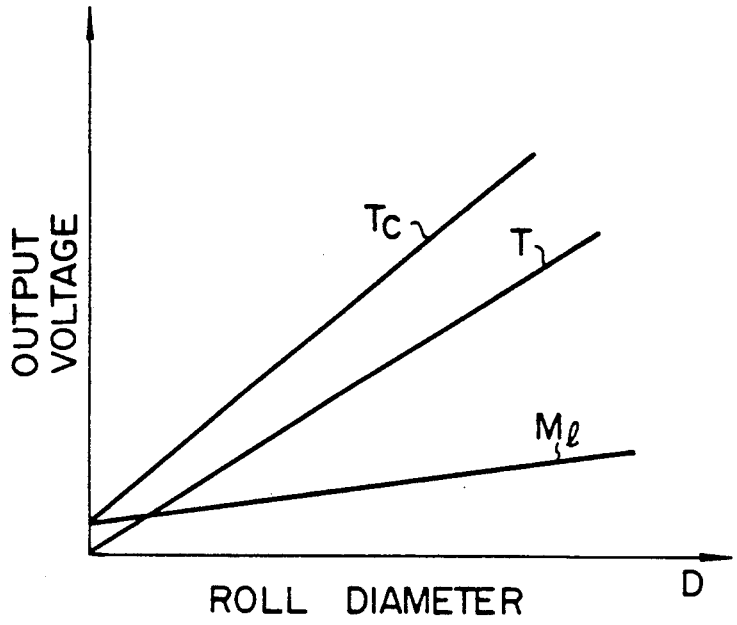
FIGS. 15 and 16 are graphs for explaining the characteristics of the tension control system of FIG. 13.

The mechanical loss component Ml is determined experimentally beforehand, and this mechanical loss component Ml (which is expressed in terms of an output voltage of the controller 304 to control the exciting current of the electromagnetic powder brake 301) is, as shown in FIG. 15, by a curve Ml, increases slightly with an increasing roll diameter D. Thus, when this mechanical loss component Ml is added to a desired braking torque T, which is determined by the relation between the roll diameter D and a set tension F, and which is shown by a curve T, the resultant braking torque Tc (which is also expressed in terms of the output voltage) will be shown by a curve Tc.

A torque calculation circuit 305 in the controller 304 is supplied with a roll diameter signal D, a mechanical loss signal Ml, and a set tension signal F, and calculates a target or desired torque signal Tc. This signal Tc is inputted to an adder 306.

On the other hand, the load detector 303 outputs a load detection signal T' representative of an actual braking torque applied to the let-off reel 101, and this signal T' is supplied or fed back to the adder 306. As a result, the adder 306 outputs an error torque signal $\Delta T$ corresponding to a difference between Tc and T', i.e., $(Tc-T')$.

Accordingly, the adder 306 or the controller 304 supplies the error signal ΔT, or an exciting voltage corresponding to the error signal ΔT to the exciting coil 301*a* of the electromagnetic powder brake 301.

Figure 16:
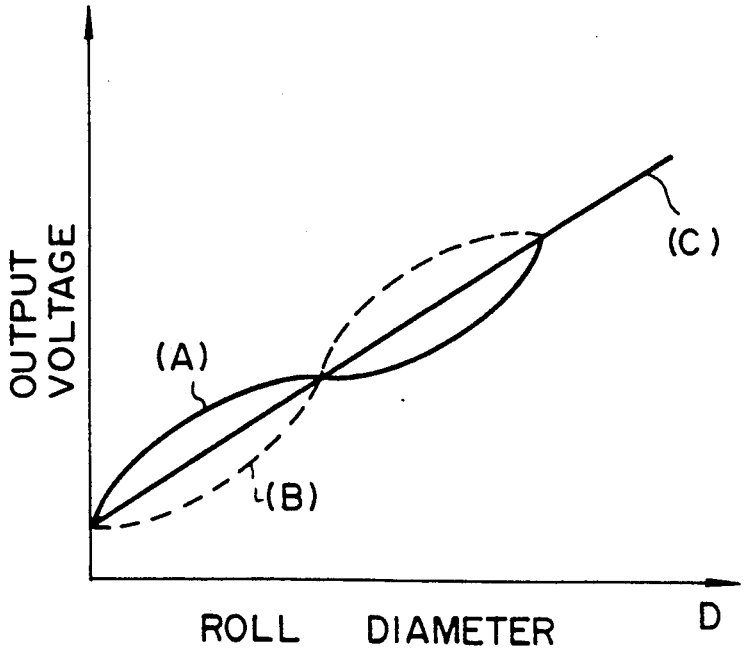

In this respect, as shown in FIG. 16 at (A), the exciting voltage applied to the electromagnetic powder brake 301 is a braking torque error signal ΔT obtained by subtracting the detected torque signal T' from the desired torque signal Tc compensated for the mechanical loss Ml. Thus, suppossing that the electromagnetic braking characteristic is varied with an increasing roll diameter D as shown by the broken line of (B), in this embodiment, however, since the feedback control is carried out by feeding back the actually detected braking torque T', the variation of the electromagnetic braking characteristic will be cancelled, and the actually detected braking torque T' which is ultimately obtained will coincide with the target torque signal Tc as shown by a curve (C).

Accordingly, in the tension control system described above, the tension of the web can be maintained at a constant value with a high accuracy.

In the magnetic braking apparatus in the present invention, since a load detector having an arm-like piezoelectric element and a coil is integrally attached between the yoke side and a stationary portion of an outside construction or facility, the following advantages are provided.

In the case of the arm-like load detector, since fixing bolt holes are formed and the load detector is easily attached and removed, the magnetic braking apparatus may be delivered with the load detector mounted thereto, or the load detector may be delivered separately as a part so that a customer can attach it later. Namely, the attachment of the load detector may be selected optionally.

Since the load detector is attached to the yoke integrally, as compared with the prior art magnetic braking apparatus in which the load detector detects a load transmitted indirectly through a torque arm, a load of such a braking torque can be detected with high accuracy. Thus, the magnetic braking apparatus attached with load detector is particularly useful in an automatic control system which performs feedback control.

When the magnetic braking apparatus include outer fins as in the first and second embodiments, since the outer fin serves for both attachment of the load detector and heat radiation, the heat radiation efficiency is also improved.

When the load detector is attached through a rotary joint, since a fine adjustment of the direction of load can be performed, the sensing accuracy can be improved.

In the tension control system using the magnetic braking apparatus in the present invention, since the tension control is carried out by incorporating a mechanical loss component and an actual tension of the web in order to improve the accuracy of the control, the following advantages are provided.

Since the mechanical loss is taken into consideration in setting the tension, the influence of the mechanical loss in the tension control can be recuded to a great extent.

Furthermore, since the actual tension of the web can be detected correctly by mounting the load detector, a variation of the characteristic of the magnetic braking apparatus due to a variation of the tension used for the feedback control can be compensated, and the accuracy of the tension control is improved to a great extent.

Accordingly, in the present invention, the accuracy of the control to maintain a constant tension is significantly improved as compared with a constant tension control of the open loop type.

While the tension control system for letting off of a web is described, the present invention will be easily applicable in a tension control system for taking up a web.

What is claimed is:

1. A braking apparatus comprising:

a rotor secured to an input shaft, said input shaft being supported rotatably by a strut;

a yoke body of a substantially cylindrical shape surrounding said rotor, said yoke body having a recess circumferentially formed in a center portion thereof, said yoke body having front and rear brackets for supporting said yoke body rotatably on a base portion of said rotor;

an exciting coil accommodated in the recess encircling said rotor;

said yoke body producing a magnetic attraction force upon excitation of said exciting coil to attract said yoke body to said rotor to apply a braking force to said rotor; and a load detector including an arm-shaped strain gauge integrally attached between said rotatable yoke body and a stationary object which is stationary with respect to said yoke body, said arm-shaped strain gauge detecting bending of and strain directly produced in said strain gauge due to relative movement between said yoke body and said stationary object.

2. A braking apparatus according to claim 1, wherein said yoke body has a plurality of outer fins fixed to an outer surface thereof, and said strain gauge is interposed between one of said plurality of outer fins and said stationary body.

3. A braking apparatus according to claim 1 wherein said yoke body comprises an attachment member and said strain gauge is connected between said attachment member and said stationary object.

4. A braking apparatus according to claim 1, wherein the arm-shaped strain gauge is an arm-shaped load cell.

5. A braking apparatus according to claim 1, comprising an electromagnetic powder brake for producing braking between said rotor and said yoke body.

6. A braking apparatus according to claim 1, comprising a friction disk brake for producing braking between said rotor and said yoke body.

7. A braking apparatus according to claim 1 comprising a hysteresis brake for producing braking between said rotor and said yoke body.

8. A braking apparatus according to claim 1 an eddy current type brake for producing braking between said rotor and said yoke body.

9. A tension control system for letting off a web wound about a let-off reel at a constant tension, comprising:

a braking apparatus for applying a braking force to said let-off reel, comprising a rotor secured to an input shaft, said input shaft being supported rotatably by a strut, a yoke body of a substantially cylindrical shape surrounding said rotor, said yoke body having a recess extending circumferentially through a center portion thereof, said yoke body having front and rear brackets for supporting said yoke body rotatably on a base portion of said rotor, an exciting coil accommodated in the recess encircling said rotor, said yoke body producing a magnetic attraction force upon excitation of said exciting coil to attract said yoke body to said rotor to apply the braking force to said rotor, and a load detector including an arm-shaped strain gauge attached between said yoke body and a stationary object which is stationary with respect to said yoke body, said strain gauge detecting bending of and strain directly produced in said strain gauge due to relative movement between said yoke body and said stationary object and providing an output signal representative of a braking torque applied to said let-off reel as a feedback signal;

a rotation detector for detecting a number of rotations of said let-off reel and outputting a signal based on the rotations;

a pulse generator for generating an output signal based on a linear traveling rate of the web;

a controller means receiving the output signals from said rotation detector and said pulse generator for calculating a roll diameter of said let-off reel based on the received output signals, and for generating a control signal representative of a desired braking torque corresponding to the calculated roll diameter; and said controller means also for calculating an error signal between the control signal representative of a desired braking torque and the feedback signal, and supplying the error signal to said braking apparatus to excite said exciting coil to achieve the constant tension.

10. A tension control system according to claim 9, comprising rotation members, wherein a mechanical loss component signal representative of a mechanical loss in rotation members in said tension control system is added to said control signal of said controller to compensate for the mechanical loss.

11. A braking apparatus comprising:

a housing;

an input shaft rotatably mounted through the housing;

means mounted on said housing for braking the input shaft, the means for braking including a movable member which exerts a force on the housing when the means for braking is engaged and the input shaft is rotating;

an arm-shaped strain gauge attached between the housing and a stationary object which is stationary with respect to said movable member and detecting bending of and strain directly produced in said strain gauge as caused by the rotational force from the means for braking.

* * * * *